United States Patent [19]

Day

[11] 4,428,662

[45] Jan. 31, 1984

[54] COLOR REPRODUCTION APPARATUS

[75] Inventor: Pierce B. Day, Pittsford, N.Y.

[73] Assignee: Eastman Kodak Company, Rochester, N.Y.

[21] Appl. No.: 289,673

[22] Filed: Aug. 3, 1981

[51] Int. Cl.³ ..... G03G 15/01; G03G 13/01

[52] U.S. Cl. ..... 355/4; 355/77

[58] Field of Search ..... 355/3 R, 4, 32, 46, 355/77

[56] References Cited

U.S. PATENT DOCUMENTS

| | | | |
|---|---|---|---|
| 2,986,466 | 5/1961 | Kaprelian | 355/4 X |
| 3,045,644 | 7/1962 | Schwertz | 118/637 |
| 3,399,611 | 9/1968 | Lusher | 95/1.7 |
| 3,420,151 | 1/1969 | Levine et al. | 355/4 |
| 3,667,841 | 6/1972 | Ross | 355/4 |
| 3,690,756 | 9/1972 | Smith | 355/4 |
| 3,724,943 | 4/1973 | Draugelis et al. | 355/4 |
| 3,970,042 | 7/1976 | Rees | 118/637 |
| 4,188,110 | 2/1980 | Stange | 355/4 X |

FOREIGN PATENT DOCUMENTS

| | | | |
|---|---|---|---|
| 54-12845 | 1/1979 | Japan | 355/4 |

*Primary Examiner*—Fred L. Braun

*Attorney, Agent, or Firm*—Lawrence P. Kessler

[57] ABSTRACT

An apparatus in which latent image charge patterns on image-receiving members, corresponding respectively to related primary color separation images of multicolor input information, are developed with pigmented marking particles to form transferable images. Two of the latent image charge patterns are simultaneously produced on discrete areas of the image-receiving members respectively. A third latent image charge pattern is produced on a discrete area of one of the image-receiving members adjacent to one of the aforementioned discrete areas. The developed images of the two simultaneously produced latent image charge patterns are transferred to a receiver member in superimposed register, with a substantial portion of the transfers occurring simultaneously. The developed image of the third charge pattern is subsequently transferred in superimposed register with the previously transferred patterns to produce the multicolor reproduction.

10 Claims, 1 Drawing Figure

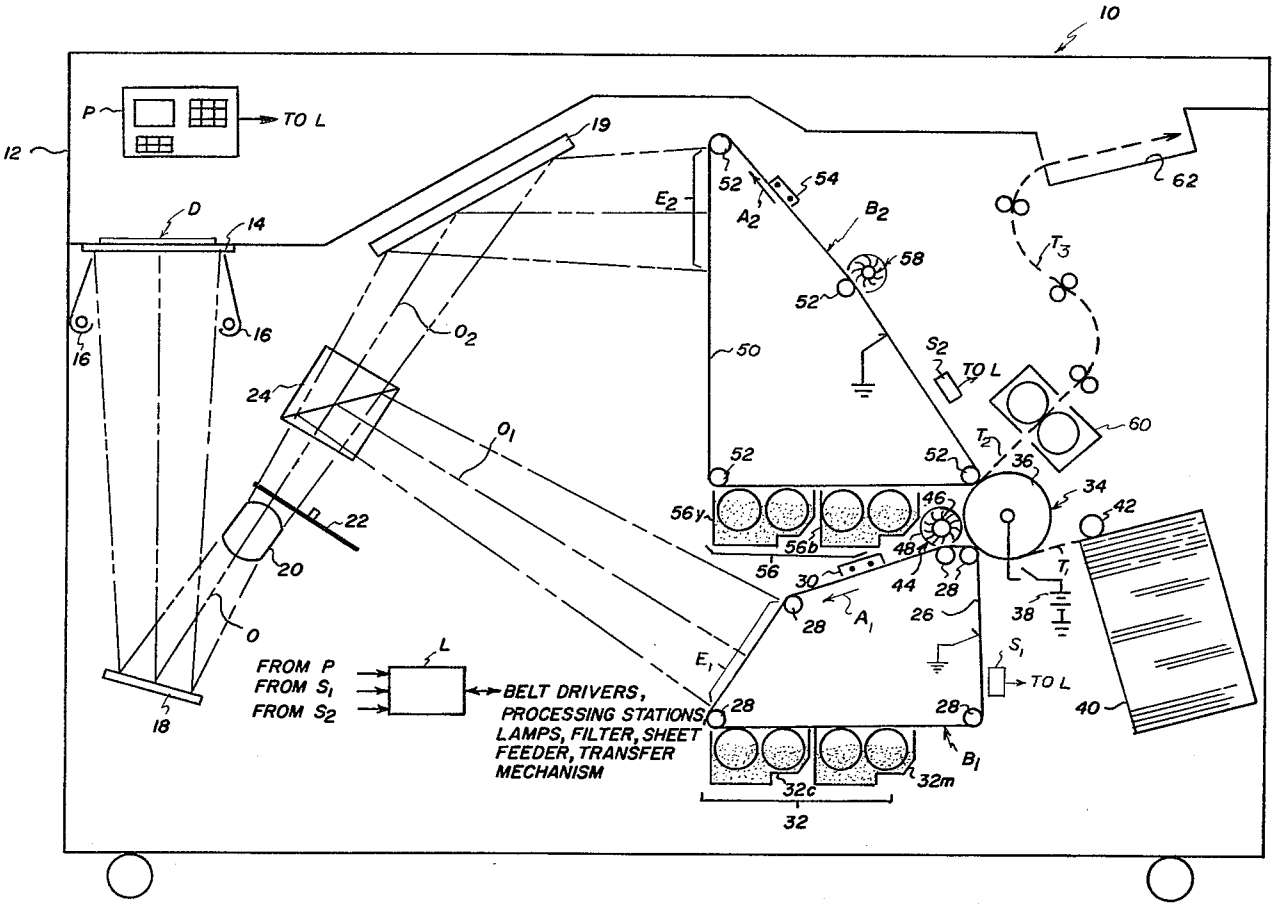
BELT DRIVERS, PROCESSING STATIONS, LAMPS, FILTER, SHEET FEEDER, TRANSFER MECHANISM
FROM P
FROM S1
FROM S2
TO L

COLOR REPRODUCTION APPARATUS

BACKGROUND OF THE INVENTION

This invention relates generally to color electrophotographic reproduction apparatus, and more particularly to an improved color electrophotographic reproduction apparatus having two photoconductive members on which different latent image charge patterns corresponding to related color images are respectively formed simultaneously, and wherein a substantial portion of the transfer of marking particle developed images of such patterns to a receiver member occurs simultaneously.

In making multicolor reproductions with an electrophotographic reproduction apparatus for example, a multicolor original document is illuminated and color separation images are formed. The color separation images expose respective image-receiving areas of a uniformly charged photoconductive member to form spaced latent image charge patterns on the member respectively corresponding to the color separation images. The latent image charge patterns are respectively developed with complementary primary colored marking particles (toner) to form developed images. The developed images are then transferred from the photoconductive member to a receiver sheet in superimposed relation to form a multicolor reproduction (copy) of the document. An illustrative example of such an apparatus is shown in U.S. Pat. No. 3,841,751 issued Oct. 15, 1974 in the name of Draugelis et al.

Since the multicolor reproduction is madeup of a plurality of marking particle developed images of latent image charge patterns on a photoconductive member proceeding serially through electrophotographic process stations, the time for making the multicolor reproduction is significantly longer than that for producing a monochrome reproduction where the process stations function at an equivalent speed. Furthermore, tracking of the photoconductive member (both cross-track and in-track) must be precisely controlled if the three or more image-receiving areas bearing the developed images are to arrive at the transfer station at the same relative location so that the developed images can be transferred to the receiver sheet in accurate superimposed register. The need for cross-track control of the photoconductive member between image-receiving areas can be eliminated by providing a plurality of spaced photoconductive members bearing the plurality of developed images respectively (see for example, U.S. Pat. No. 4,162,843 issued July 31, 1979 in the name of Inoue et al). However, with plural photoconductive members complexities arise in accurately projecting color separation images onto the plurality of photoconductive members, and sequentially registering a receiver sheet with the respective members bearing the developed images for accurate superimposed transfer. Further, the reproduction rate remains reduced because the respective transfers to a receiver sheet take place sequentially at spaced locations.

SUMMARY OF THE INVENTION

This invention is directed to an improved color reproduction apparatus in which latent image charge patterns on image-receiving members, corresponding respectively to related primary color separation images of multicolor input information, are developed with pigmented marking particles to form transferable images. Two of the latent image charge patterns are simultaneously produced on discrete areas of the image-receiving members respectively. A third latent image charge pattern is produced on a discrete area of one of the image-receiving members adjacent to one of the aforementioned discrete areas. The developed images of the two simultaneously produced latent image charge patterns are transferred to a receiver member in superimposed register, with a substantial portion of the transfers occurring simultaneously. The developed image of the third produced latent image charge pattern is subsequently transferred in superimposed register with the previously transferred patterns to produce the multicolor reproduction. In this manner such reproduction is produced in substantially less time than would be required with three sequential transfers. Additionally, cross-track control of an image-receiving member during transfer of developed images on two successive discrete areas is less critical than would be required during transfer of developed images on three or more successive areas.

The invention, and its objects and advantages, will become more apparent in the detailed description of the preferred embodiment presented below.

BRIEF DESCRIPTION OF DRAWING

In the detailed description of the preferred embodiment of the invention reference is made to the accompanying drawing, in which:

The FIGURE is a schematic illustration of a color electrophotographic reproduction apparatus having two photoconductive members according to this invention.

DESCRIPTION OF PREFERRED EMBODIMENT

The accompanying FIGURE schematically illustrates a color reproduction apparatus, designated generally by the numeral 10. While the apparatus 10 is described as being of the electrophotographic type having optically produced color separation images of an original multicolor document, it is within the scope of this invention for the apparatus to be of any other electrostatic type producing color separation images (e.g., electronically) of input information. The apparatus 10 includes a housing 12 having a transparent platen 14 mounted on the housing for supporting a multicolor original document D to be reproduced. An illumination source, such as flash lamps 16 for example, are supported in the housing adjacent to the platen 14. The lamps selectively flood the document D with light to produce a reflected light image of the document.

The reflected light image of the document is projected by a first mirror 18 along an optical path O through a lens 20 and dichroic filter wheel 22 to a dichroic beam splitter 24. When the apparatus 10 employs the subtractive color reproduction process, the passbands of the filter wheel 22 and beam splitter 24 are selected such that the reflected light image reaching the beam splitter is comprised of two primary color separation images. Such images are then separated by the beam splitter for respective projection along divergent optical paths $O_1$ and $O_2$ to dual photoconductive belts $B_1$ and $B_2$. Path $O_1$ is directed to an exposure station $E_1$ for photoconductive belt $B_1$, while the path $O_2$ of equal conjugate length is directed via mirror 19 to an exposure station $E_2$ for photoconductive belt $B_2$.

The photoconductive belt $B_1$ is a grounded continuous web 26 of a construction such as that shown for example in U.S. Pat. No. 3,615,414 issued Oct. 26, 1971 in the name of Light. The web 26 is supported on rollers 28 to form a closed loop path. One of the rollers (e.g., lower left roller of the FIGURE) is driven to move the web 26 about its path in the direction of arrow $A_1$. The web 26 has a plurality of marks or perforations (not shown) located adjacent to one marginal edge and associated with the plurality of discrete image-receiving areas on the web respectively. A sensor $S_1$ operatively connected to a logic and control unit L produces signals when the marks are detected. The unit L includes, for example, an Intel 8080 microprocessor available from Intel Corp. of Sacremento, Calif. The signals from the sensor $S_1$ are received by the unit L and utilized by the unit to determine the location of the image-receiving areas in the path of web 26 to accurately control the timing of the operation of electrophotographic processing stations relative to such areas.

Typical electrophotographic processing stations are located about the path of the web 26 to function on the web as it moves about its path. Particularly, a primary charge corona 30, located upstream of the exposure station $E_1$, places a uniform electrostatic charge on the web 26 as it passes under the corona. At the exposure station, a color separation image projected along optical path $O_1$ selectively reduces the charge on the web in a discrete image-receiving area to form a corresponding latent image charge pattern. The latent image charge pattern is developed at the developing station 32 to form a developed image. The developing station 32 includes, for example, a pair of magnetic brush developer assemblies **32*m* and 32*c* containing pigmented marking particles of a color respectively complementary to color separation images projected to the web 26. The particles are for example of the type described in U.S. Pat. No. 3,893,935 issued July 8, 1975 in the name of Jadwin et al, and are triboelectrically charged in an opposite sense to the latent image charge patterns. An assembly containing particles complementary in color to the color separation image used to form the charge pattern is activated, such as by bringing the brush into contact with the web 26**, so that particles are attracted to the latent image charge pattern to develop such pattern.

The developed image is transferred to a receiver sheet at a transfer station 34. The transfer station 34 includes a rotatably driven transfer roller 36, for example of the type shown in the aforementioned U.S. Pat. No. 3,841,751. The transfer roller 36, which is operatively connected to a D.C. (or biased A.C.) power supply 38, contacts the web 26 adjacent to the upper right support roller 28. A receiver member, such as a cut sheet of bond paper or transparency material, is fed from a supply hopper 40 by a feed mechanism 42 along the transport path $T_1$ (shown by broken line in the FIGURE) and clamped to the roller 36. The roller 36 charges the receiver member to a level of the same polarity but substantially greater absolute value than the level of the attractive force on the particles by the charge on the web 26. Accordingly, the charge effects transfer of the developed image from the web to the receiver member. A cleaning station 44, including a brush 46 rotating in a vacuum housing 48, removes any residual particles remaining on the web prior to subsequent movement of the web through the electrophotographic processing stations.

The construction of the photoconductive belt $B_2$ is similar to that described relative to photoconductive belt $B_1$. Specifically, the belt $B_2$ is a grounded continuous photoconductive web 50 supported on rollers 52 to form a closed loop path. One of the rollers (e.g., lower left roller of the FIGURE) is driven to move the web 50 about its path in the direction of arrow $A_2$ at a linear speed equal to that of web 26. The web 50 has a plurality of marks or perforations (not shown) located adjacent to one marginal edge and associated with the plurality of discrete image-receiving areas on the web respectively. A sensor $S_2$, operatively connected to the logic and control unit L, produces signals when marks on the web 50 are detected. The signals are received by the unit L and utilized by the unit to accurately control the timing of the operation of electrophotographic processing stations relative to location of the image-receiving areas in the path of web 50. Typical electrophotographic processing stations, similar to those described above relative to belt $B_1$, are located about the path of web 50 to function on the web as it moves about its path. Particularly, the processing stations include a primary charge corona 54, an exposure station $E_2$, a developing station 56 having a pair of magnetic brush developer assemblies **56*y* and 56*b* (containing marking particles of a color respectively complementary to color separation images projected to the web 50), and a cleaning station 58. The transfer roller 36 contacts the web 50 adjacent the lower right support roller 52 to respectively transfer a developed image from the web 50** to a receiver member clamped to the transfer roller.

In utilizing the reproduction apparatus 10 for making a multicolor reproduction of multicolor inut information such as a copy of document D, an operator programs the logic and control unit L for the number of reproductions desired and the start of reproduction by activating a program and display panel P. Appropriate signals are produced in the panel which is operatively connected to the unit L. The unit L then energizes the drive to move the belts $B_1$ and $B_2$ about their respective paths and turns on the corona chargers 30 and 54. As noted above, sensors $S_1$ and $S_2$ produce signals for the unit L so that location of discrete image-receiving areas on the respective belts are determined as the belts travel in their respective paths. At the appropriate time determined by the logic and control unit L, lamps 16 are flashed to produce a reflected light image of the document, focused by the lens 20, and projected through the filter wheel 22 to the beam splitter 24. While the multicolor reproduction can be madeup of three primary color separation images (red, green, blue), in the preferred embodiment the reproduction includes the three primary color separation images plus an image of black copy of the document.

The filter wheel 22 is positioned by the unit L so that a filter sector is in the optical path O which passes, for example, both a green color separation image and an image of any black copy of the document D. The beam splitter 24 separates the green color separation image and the black image so that the green image is projected on optical path $O_1$ to exposure station $E_1$ and the black image is projected on optical path $O_2$ to exposure station $E_2$. At a subsequent time determined by the unit L and equal to the time required for the next image-receiving area to be located at the exposure station, the lamps 16 are again flashed to produce a second reflected light image of the document. At a time prior to the second flash, the filter wheel 22 is repositioned by the unit L so that a filter sector is in the optical path O which passes both a red color separation image and a blue color separation image. The beam splitter 24 separates the red and blue color separation images so that the red image is projected on optical path $O_1$ to exposure station $E_1$ and the blue image is projected on optical path $O_2$ to exposure station $E_2$.

At the exposure station $E_1$ and $E_2$ respective latent image charge patterns corresponding to the first projected images are formed in discrete image-receiving areas of belts $B_1$ and $B_2$ and respective latent image charge patterns corresponding to the second projected images are formed in respective subsequent discrete image-receiving areas of the belts. The logic and control unit L is programmed to activate respective magnetic brush developer assemblies 32*m*, 32*c*, 56*b*, 56*y* in relation to the location of the discrete image-receiving areas of the belts to develop the latent image charge patterns carried thereon with respective complementary colored marking particles (except the charge pattern corresponding to the image of black copy is developed with black marking particles) to form developed images. The areas between successive image-receiving areas on the respective belts are selected to equal the length of a developer assembly (in the direction of belt travel) so that development of a particular charge pattern is completed before another charge pattern passes over such assembly for development. Such spacing prevents contamination of a developer assembly by particles from an adjacent assembly.

The developed images are then carried by the respective belts toward the transfer station 34. The length of travel of belt $B_2$ from the exposure station $E_2$ to its line of contact with the transfer roller 36 is equal to the length of travel of belt $B_1$ from the exposure station $E_1$ to its line of contact with the transfer roller 36, plus a distance equal to the distance between the respective lines of contact measured about the circumference of the transfer roller. By such arrangement, the lead edges of the respective developed images on the belts $B_1$ and $B_2$ reach their lines of first contact with the transfer roller in time for transfer to a receiver member in accurate superimposed register.

The logic and control unit L activates the sheet feed mechanism 42 at such time that a receiver member transported and clamped to the rotatably driven transfer roller 36 arrives at the line of contact with belt $B_1$ in register with the first developed charge pattern on such belt. The circumference of the roller 36 equals the length of an image-receiving area on the belt plus the area between successive image-receiving areas measured in the direction of belt travel. Further, the angular velocity of the roller 36 is selected so that the peripheral speed of the roller circumference matches the linear speed of the belts. As the roller 36 is rotatably driven, transfer of the first developed image on belt $B_1$ to the receiver member is effected, and since the peripheral speed of the circumference of the roller 36 matches the linear speed of the belt, transfer is accomplished without smearing of the image. The roller 36 then transports the receiver member to the line of contact with belt $B_2$ and, due to the added path length of belt $B_2$ (from exposure station $E_2$), transfer of the first developed image on such belt is effected in superimposed register with the image transferred from belt $B_1$, without smearing. A substantial portion of the transfer of the image from belt $B_2$ occurs simultaneously with the transfer of the image from belt $B_1$.

As the roller 36 continues to rotate, the clamped receiver member is returned to the respective lines of contact with belts $B_1$ and $B_2$. As a result of the match in roller circumference to the distance between successive developed images on the respective belts and the match of the speeds of the roller circumference and the belts, the receiver member is in register with the respective second developed images on such belts. Such images are thus respectively transferred to the receiver member in accurate superimposed register to form the multicolor reproduction, a substantial portion of such transfers occuring simultaneously. After transfer of the last developed image from belt $B_2$ is begun, the lead edge of receiver member is released (unclamped) and directed such as by a stripper member (not shown) to travel in the path $T_2$ to a fuser assembly 60. As the receiver member travels through the fuser assembly, the superimposed transferred images are permanently fixed to the member, such as by heat and/or pressure. The fixed multicolor reproduction is then transported along path $T_3$ to an output hopper 62 for operator retrieval.

The photoconductive belt arrangement of the reproduction apparatus 10 has a higher throughput rate than possible with previous color copiers because only two illumination operations are required for a complete multicolor reproduction and because a substantial portion of the transfer of two developed images occur simultaneously. Moreover, since each belt has related developed images in only two successive image-receiving areas, belt tracking in the cross-track direction is less critical than if three or more related images were in successive areas. That is, any cross-track deviation would occur only over the path length of two successive image-receiving areas, rather than over the proportionately longer path length of three or more areas. To further improve the reproduction rate, the belts may have more than two discrete image-receiving areas so that more than one reproduction (of the same or different input information) may be in progress at the same time. Of course, according to this invention, only two of the areas will contain related developed images for a particular reproduction.

The invention has been described in detail with particular reference to a preferred embodiment thereof, but it will be understood that variations and modifications can be effected within the spirit and scope of the invention.

I claim:

1. In apparatus having means for developing latent image charge patterns on image-receiving members with pigmented marking particles to form transferable images respectively corresponding to related color images of multicolor input information, wherein said developed images are transferred to a receiver member to produce a multicolor reproduction, the improvement comprising:

means for simultaneously producing two different ones of said latent image charge patterns on discrete areas of said image-receiving members respectively;

means or producing a third latent image charge pattern, different from said aforementioned latent image charge patterns, on a discrete area of one of said image-receiving members adjacent to one of said aforementioned discrete areas; and means for transferring developed images to a receiver member in superimposed register, with a substantial portion of the transfer of the developed images of said simultaneously produced latent image charge patterns occuring simultaneously.

2. The invention of claim 1 further comprising:

means for producing a fourth latent image charge pattern, corresponding to a related black portion of such input information, on the other of said image-receiving members in a discrete area adjacent to one of said aforementioned discrete areas, and wherein said transfer means transfers the developed image of said fourth latent image charge pattern to such receiver member with a substantial portion of the transfer occurring simultaneously with the transfer of the developed image of said third latent image charge pattern.

3. The invention of claim 2 wherein said image-receiving members are charged endless photoconductive belts, and said latent image charge pattern producing means includes means for simultaneously optically exposing discrete areas of said belts to different related color images of such multicolor input information respectively.

4. The method of producing a composite multicolor reproduction of multicolor input information on a receiver member which comprises the steps of:

simultaneously producing two latent image charge patterns, corresponding to two related primary color separation images of the multicolor input information, on discrete areas of image-receiving members respectively, and developing such patterns with colored marking particles to form transferable images;

producing a third latent image charge pattern corresponding to a third related primary color separation image of the multicolor input information on a discrete area of one of the image receiving members adjacent to one of the aforementioned discrete areas, and developing such pattern with colored marking particles to form a transferable image; and transferring the three transferable images in superimposed register onto a receiver member, with a substantial portion of the transfer of the developed images of the simultaneously produced latent image charge patterns occurring simultaneously.

5. Apparatus for producing, on a receiver sheet, a multicolor reproduction of multicolor input information, said apparatus comprising:

means for producing a plurality of related color images of multicolor input information, and for simultaneously directing first and second different color images of such related images along divergent first and second paths respectively, and subsequently simultaneously directing third and fourth different color images of such related images along said paths respectively;

a first photoconductive member adapted to receive a uniform electrical charge, means for moving said first photoconductive member to intersect said first path to receive directed images in respective discrete areas of such member, to form latent image charge patterns respectively corresponding to the color images directed in said first path, and means for developing the latent image charge patterns with transferable colored marking particles to form developed images on said first photoconductive member;

a second photoconductive member adapted to receive a uniform electrical charge, means for moving said second photoconductive member to intersect said second path to receive directed images in respective discrete areas of such member, to form latent image charge patterns respectively corresponding to the color images directed in said second path, and means for developing the latent image charge patterns with transferable colored marking particles to form developed images on said second photoconductive member; and means, located in juxtaposition with said first and second moving photoconductive members, for transferring substantially simultaneously, developed images of such produced color images simultaneously directed along divergent paths, from said first and second photoconductive members to a receiver sheet in accurate superimposed register to form a multicolor reproduction.

6. Apparatus for producing, on a receiver sheet, a multicolor copy of a multicolor original document, said apparatus comprising:

means for producing a reflected light image of an original document and directing such image along an optical path;

means in said optical path for producing two related color images from a reflected light image of an original document and simultaneously directing such two related images along divergent first and second paths respectively, and subsequently producing two different related color images from a reflected light image of such original document and simultaneously directing such different related images along said divergent paths respectively;

a first photoconductive member adapted to receive a uniform electrical charge, means for moving said first photoconductive member to intersect said first path to receive directed images in respective discrete areas of such member, to form latent image charge patterns respectively corresponding to the color images directed in said first path, and means for developing the latent image charge patterns with transferable colored marking particles to form developed images on said first photoconductive member;

a second photoconductive member adapted to receive a uniform electrical charge, means for moving said second photoconductive member to intersect said second path to receive directed images in respective discrete areas of such member, to form latent image charge patterns respectively corresponding to the color images directed in said second path, and means for developing the latent charge images with transferable colored marking particles to form developed images on said second photoconductive member; and means, located in juxtaposition with said first and second moving photoconductive members, for transferring substantially simultaneously, developed images of such produced color images simultaneously directed along divergent paths, from said first and second photoconductive members to a receiver sheet in accurate superimposed register to form a multicolor copy of the original document.

7. The invention of claim 6 wherein said related color image producing means includes a dichroic filter having sectors of selected passbands for respectively passing two related color images along said optical path, and a dichroic beam splitter of selected passbands for directing one of such related color images along said first path and the other of such related color images along said second path.

8. The invention of claim 6 wherein said transfer means includes a rotatably driven roller operatively connected to a potential source and adapted to clamp a receiver sheet to the peripheral surface thereof, said roller establishing a first line of contact with said first photoconductive member and a second line of contact with said second photoconductive member, said second line of contact being spaced in the direction of rotation of said roller from said first line of contact.

9. The invention of claim 8 further including means for moving said photoconductive members at equal linear speeds and for driving said roller at a peripheral speed equal to the linear speed of said photoconductive members.

10. The invention of claim 9 wherein the spacing between said first and second lines of contact equals the difference between the linear distance between the intersection of said second photoconductive member with said second path and the second line of contact, and the intersection of said first photoconductive member with said first path and the first line of contact, whereby developed images, of produced color images simultaneously directed along divergent paths, or respective moving photoconductive members arrive at said respective lines of contact so that transfer is effected in accurate superimposed register.

* * * * *